US006896770B2

(12) United States Patent
Lamminpääet al.

(10) Patent No.: US 6,896,770 B2
(45) Date of Patent: May 24, 2005

(54) ARRANGEMENT WITHIN A YANKEE CYLINDER OR THE LIKE AND A ROLLER OF A PAPER MACHINE

(75) Inventors: Osmo Lamminpää, Gorizia (IT); Juha Leimu, Turku (FI); Carlo Morini, Gorizia (IT)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/415,537

(22) PCT Filed: Nov. 1, 2001

(86) PCT No.: PCT/FI01/00954

§ 371 (c)(1),
(2), (4) Date: Aug. 8, 2003

(87) PCT Pub. No.: WO02/36881

PCT Pub. Date: May 10, 2002

(65) Prior Publication Data

US 2004/0093757 A1 May 20, 2004

(30) Foreign Application Priority Data

Nov. 1, 2000 (FI) ..... 20002404

(51) Int. Cl.[7] ..... D21F 1/12; D21F 1/29

(52) U.S. Cl. ..... 162/281; 162/283; 162/280; 162/272; 34/114; 34/117; 34/119; 34/120; 34/239

(58) Field of Search ..... 162/281, 272, 162/283, 280; 34/114, 117, 119, 120, 239

(56) References Cited

U.S. PATENT DOCUMENTS

| | | | | |
|---|---|---|---|---|
| 3,762,067 A | | 10/1973 | Whittaker et al. | |
| 4,019,953 A | | 4/1977 | Nystrom | |
| 4,088,066 A | | 5/1978 | Bailey | |
| 4,906,333 A | | 3/1990 | Myren | |
| 5,011,574 A | | 4/1991 | Gustavsson et al. | |
| 5,199,623 A | | 4/1993 | Rajala et al. | |
| 5,738,760 A | | 4/1998 | Svanqvist et al. | |
| 5,878,462 A | | 3/1999 | Lindén et al. | |
| 5,891,309 A | | 4/1999 | Page et al. | |
| 6,004,432 A | | 12/1999 | Page et al. | |
| 6,006,444 A | | 12/1999 | Bauböck et al. | |
| 6,068,735 A | * | 5/2000 | Marchal | 162/272 |
| 6,193,846 B1 | | 2/2001 | Lelmu | |
| 6,669,818 B2 | * | 12/2003 | Linden | 162/283 |

FOREIGN PATENT DOCUMENTS

| | | |
|---|---|---|
| FI | 82105 | 9/1990 |
| FI | 103662 B | 8/1999 |
| JP | 9-143892 | 6/1997 |
| WO | WO 02/36881 A1 | 5/2002 |

OTHER PUBLICATIONS

International Search Report issued in International Patent Application No. PCT/FI01/00954.

* cited by examiner

*Primary Examiner*—Mark Halpern
(74) *Attorney, Agent, or Firm*—Stiennon & Stiennon

(57) ABSTRACT

A Yankee cylinder or the like at the dry end of a paper machine has at least a drying cylinder, a hood covering the drying cylinder, a web guiding means, and a roller. After the drying cylinder at the dry end of the machine, seen in the machine direction, a covered area which above and on the sides is at least mainly covered extends at least to the area of the roller.

16 Claims, 3 Drawing Sheets

ARRANGEMENT WITHIN A YANKEE CYLINDER OR THE LIKE AND A ROLLER OF A PAPER MACHINE

CROSS REFERENCES TO RELATED APPLICATIONS

This application is a U.S. national stage application of International Application No. PCT/FI01/00954, filed Nov. 1, 2001, and claims priority on Finnish Application No. 20002404 filed Nov. 1, 2000, the disclosures of both of which applications are incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to an arrangement within a Yankee cylinder or the like and a roller of a paper machine, particularly in order to improve the runability, to solve linting problems and thus to reduce production disturbances, and to improve the fire safety of the paper machine.

In a paper machine a Yankee cylinder dryer and a hood connected to it are generally used to dry a paper web, whereby hot air is blown at a high speed from the hood against the paper web on the surface of the cylinder in order to improve the drying effect. The paper web is detached from the cylinder's surface with the aid of a doctor blade. Already in this phase a substantial amount of lint comes off the paper, particularly from soft tissue. The paper is conveyed with the aid of mechanical conveying equipment to the roller, and also in this phase lint will come off the paper. At the roller a part of the lint will stay within the roll being made, but a part of the lint is lost to the surrounding air, which is hot and flows strongly upwards spreading the lint further into the paper machine room.

As the speed of the paper web is quite high, usually at least 1500 m/min, even over 2000 m/min, the created amount of lint is quite high. Due to the high speed, fibres and other particles will quite easily come off the paper. Moreover, due to the high speed the lint will get a quite high speed in the air flow, and therefore it will be spread effectively. The lint has many harmful effects. It will accumulate as a layer on the surfaces of structures, particularly on other than vertical surfaces. The lint may come off the surfaces as lumps and fall down on the paper web so that it causes a production break. The lint may even catch fire, because a part of the equipment is very hot, in spite of the insulations. Thus a part of the paper machine may even be destroyed which causes at least an interruption in the production, but usually it also requires reparations. The lint content in the paper machine room should at least not rise above the limits allowed by the health authorities. Removal of lint by cleaning the paper machine is a separate operation, which as such generates costs, and often also lengthens the production breaks. If the lint is removed with the aid of a water jet, this can cause additional problems as the equipment and structures get wet.

A number of solutions are known for reducing the linting problems in the region of a Yankee cylinder dryer and a roller. The publications U.S. Pat. Nos. 5,011,574 and 4,019,953 present equipment to be located close to the doctor blade, in order to remove the lint created just at that point. The publication WO 97/44525 shows a shaped suction box for sucking away lint from between the Yankee cylinder and the roller. The publications thus present some partial solutions, but they do not show an effective total solution for removing the linting problems.

SUMMARY OF THE INVENTION

The object of the invention is to present an arrangement which improves the runability of a paper machine, due to the fact that the many harmful effects of the lint, which has come off the paper web in the regions of a Yankee cylinder dryer or the like and a roller, can be obviated or at least clearly reduced. The object of the invention is more specifically to improve the efficiency of a paper machine, to increase the production rate, to improve the quality of the manufactured product, to improve the reliability and the usability of the machine, to improve the fire safety of the dry end of a paper machine, to reduce the need for cleaning of the paper machine and the paper machine room, to improve the air quality in a paper machine room, and to reduce the noise in the paper machine room.

At the dry end of the paper machine there is often used a Yankee cylinder dryer or the like containing at least a drying cylinder as well as a drying cylinder hood with its equipment. For the control of the paper web there is often used mechanical web guide members, which through contact guide the paper web. After these the paper web is rolled by a roller. If at the dry end of the machine the covered region, which in the machine direction after the drying cylinder is at least mainly covered from above and on the sides, continues at least to the region of the roller, then the dry end can be quite effectively isolated from the rest of the paper machine room, if in this area also the walls are covered in addition to a cover above. The loose lint can be removed from the space formed in this manner with the aid of suction devices.

If the top surface of the covered area is downwards sloping in the machine direction, then the relatively large height required by the drying cylinder and its hood can be reduced, beginning from a point at the drying cylinder and continuing in the machine direction in the covered area, as the equipment typically located in this covered area require relatively little space in the height direction. At the dry end of the paper machine the temperature is quite high at some points, and even if the aim is to isolate the hot parts with the aid of thermal insulation, the hot air tends to rise upwards and take with it the lint, if there is any in the air.

If at least a portion of the upper part of the covered area is movable, then the covered area can be moved as required, for instance in connection with the change of rolls or maintenance work. If the top surface of the covered area is mainly smooth and even at least in the machine direction, then the surface can be kept rather clean, as otherwise lint or other harmful substances may accumulate at the discontinuing points of the surface.

If the covered area at the drying cylinder is connected to the hood without any substantial step, then it is easy and simple to keep this area clean. If the joint between the covered area and the hood is at least approximately tight, then no lint can pass this way either into the paper machine room.

If the covered area also covers the roller, so that the lint coming loose at the roller is kept at least mainly under within the covered area, then the lint sources of the paper machine's dry end are effectively covered.

If the lint coming loose from the paper web at the roller area is guided with the aid of an air curtain, then the structure does not hardly at all interfere with the operation of the paper machine nor with the maintenance work, but even an air curtain is in some places a sufficient solution instead of fixed structures in controlling the linting problem.

If an air suspension and/or air redirecting device is used above the paper web between the drying cylinder and the roller to guide the paper web and to convey it to the roller, then the paper web is in no mechanical contact with rolls or other web guide members. Such an arrangement creates less lint and only minor amounts of lint come off the web in this area.

If lint is discharged together with the air from the area of the air suspension and/or air redirecting device, then also the amount of lint within the covered area is even smaller. If a negative pressure is arranged within the space above the air suspension and/or air redirecting device, then this negative pressure prevents the lint coming off the paper web from spreading into the paper machine room, and there will be still less problems caused by the lint in this area. However, only a minor negative pressure must be created, so that this negative pressure does not create problems regarding the paper web.

If the negative pressure is arranged with the aid of one or more discharge channels, then the size, shape, position and the negative pressure of the discharge channel can be chosen so that the discharge channel creates a desired effect. If there is arranged one or more air curtains to define said negative pressure space, then there are no walls nor equipment to hinder operation or maintenance in the same way as there would be when using fixed structures.

If the outer surfaces of the piping and other equipment are arranged to be substantially vertical in the negative pressure space above the air suspension and/or air redirecting devices, whereby the space extends up to the roller, then such surfaces can hardly accumulate any lint. Also the top surface of the air suspension and/or air redirecting devices advantageously has such a shape that no lint can accumulate there.

If the piping and other equipment are directed through the approximately horizontal wall defining the upper part of the negative pressure space, then neither these structure parts can collect any substantial amounts of lint.

If the covered area between the Yankee cylinder and the roller comprises a chamber having at its lower part a wall which separates the chamber from the space below it, and in which chamber there is arranged a positive pressure with the aid of an air flow, then no dust can pass into this chamber due to the positive pressure. Even a slight overpressure is sufficient to prevent lint from passing into the chamber. If the supply and discharge piping, lint suction equipment and control and regulation devices are mounted in said chamber, then such devices in this space are well protected from lint.

If a blowing equipment is arranged close to the upper surface of the covered space, which blowing equipment blows pressurised air against the top surface of the covered area, against the machine direction, then the blowing equipment keeps the air in motion so much that no lint can accumulate on such a surface. Moreover, such blowing equipment is simple and inexpensive to manufacture, install and operate.

If air is discharged from the blowing device at a flow rate which is so high that no lint is left on the top surface of the covered area, then the lint always flowing with the air can not accumulate in these areas. If a plurality of nozzles or nozzle groups and/or directed blowing openings are arranged to blow against the top surface of the covered area, so that due to their combined action the whole covered area or at least the main part of it is kept free of a lint layer, then the covered area can be reliably kept quite clean without any further actions.

BRIEF DESCRIPTION OF THE DRAWINGS

The invention is presented in more detail below with reference to the enclosed drawing.

DESCRIPTION OF THE PREFERRED EMBODIMENTS

Figure 1:
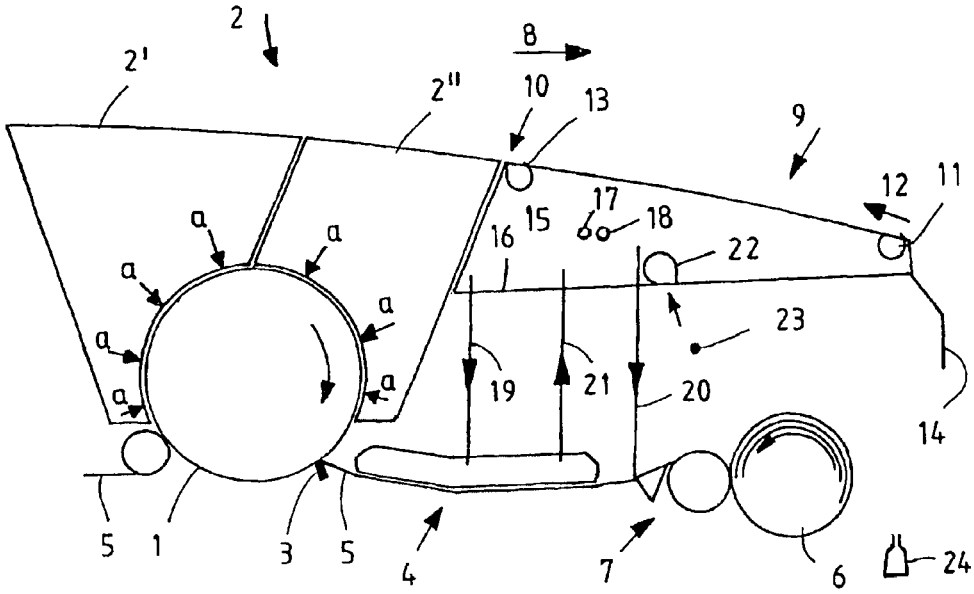
FIG. 1 shows schematically in a side view an arrangement according to the invention at the dry end of a paper machine.

The reference numeral 1 in the drawing FIG. 1 represents a Yankee cylinder whose upper parts are completely covered by the halves 2' and 2" of the hood 2. The arrows a represent basically the blow against the surface of the paper web. The Yankee cylinder has a doctor blade 3, which detaches the paper web from the surface of the Yankee cylinder. The reference numeral 4 represents web guiding means, with which the travel of the paper web 5 is guided, and which change the direction of the paper web 5 before the roller 6, when required. In order to guide the paper web before the roller 6 there can be used auxiliary equipment 7, for instance the blow box and the support cylinder shown in FIG. 1. In addition it is possible to use different means to process the web, such as a calender (not shown). In the machine direction, represented by the arrow 8, there is after the hood 2 a covered area 9, which joins the hood section 2" at 10 so that the top surface of the hood section 2" at that point and the top surface of the covered area 9 are at least approximately on the same level, and in addition extending at least approximately in the same direction. The joint between the hood section 2" and the covered area 9 is at least approximately tight. At that end of the covered area 9 which is towards the roller 6, and where the covered area 9 with an approximately even top surface ends in the machine direction, there is arranged a blow box 11 being a part of the blowing apparatus, so that this blow box blows air in the direction on the arrow 12 through a slot at the top surface of the covered area 9, the air having a speed which is so high that no lint or the like is left in the effective area of the blow.

The reference numeral 13 represents a second blow box which operates in the same way as the blow box 11. The length of the blow boxes 11, 13 in the cross direction of the paper machine is approximately the same as the width of the covered area 9 in the machine cross direction. Of course there can be even more blow boxes, whereby the cleaning effect is in general more reliable, even if the blowing speed would be quite low. Instead of blow boxes it is possible to use nozzle rows which have a large number of nozzles. In order to have an effective cleaning effect of the blow the covered area 9 is made of a material having a smooth top surface, such as a coated steel plate. At the end of the covered area 9, close to the roller 6, there is a movable part 14, for instance a damper or the like, which can be moved as a roll is changed. The object of the movable part 14 is to cover the area of the roller 6, so that at least no substantial amounts of lint can come from this direction either into the paper machine room. The movable part 14 can be for instance fabric reinforced rubber or plastic mounted in a frame structure which is moved by pneumatic cylinders (not shown). The movable part 14 can even be so large that it covers, in addition to the end, also a part of the tail end of the top surface of the covered area 9.

The covered area 9 also includes a chamber 15 having at its lower part a floor 16, which forms an approximately tight structure downwards. The structure of the chamber 15 is such that during running of the paper machine there may be performed inspection, adjustment and control actions, even maintenance actions in the chamber 15. Therefore there are arranged passages to the chamber, a door which can be tightly shut, an air lock construction when required, and lighting. A slight overpressure compared to the air pressure in the paper machine room is maintained in the chamber 15, so that lint coming from the paper web 5 below the chamber 15 can not travel into the chamber 15. Piping and equipment relating to the operation of the paper machine's dry end are located in the chamber 15.

The input air pipe 17 and the discharge air pipe 18 have been presented schematically, and they are directed to the side of the paper machine's dry end, so that they should not present an obstacle for the equipment above the covered area 9 or correspondingly for the equipment below the chamber 15. The actual piping within the chamber 15 is not shown. The input air pipe 17 is branched into many feed lines, in which the pressure levels and flows are controlled to be suitable for each application. In FIG. 1 the feed line 19 is intended to be used by the web guiding means 4, and the feed line 20 is intended for the needs of the auxiliary equipment 7. Air supplies are provided also for the blow boxes 11 and 13 as well as for providing an overpressure in the chamber 15 itself. The discharge air pipe 18 from the chamber 15 also receives the discharge air flow from the discharge air pipe 21 of the web guiding means 4. The discharge air flow box 22 aids in keeping a slight negative pressure in the space 23 below the chamber 15 by directing the air and with it the lint into the discharge air pipe 18. An air curtain 24 is used for directing the lint containing air flow, due to the roller 6, into the space 23 and further into the discharge pipe 18. Air curtains can be used at the hot end of the paper machine also at other locations (not shown), if there is required an even more efficient way to prevent harmful spreading of lint into the paper machine room.

In the space 23 the piping and the corresponding devices are at least approximately vertical, so that the lint should not accumulate on any surface and thus cause disturbances in the production. Below the paper web 5 there are very few devices, so that the paper web 5 at a possible production interruption can without hindrance pass to a conventional space (not shown) designed for broke below the paper web 5.

In the arrangement illustrated in FIG. 1 there is a covered area 9 in the region, which seen in the machine direction is located after the Yankee cylinder's 1 hood 2, which hood as such is conventional, whereby the covered area at the dry end of the paper machine mainly covers that area, from which the major part of the lint has been spread into the paper machine room without an arrangement according to the invention. A movable part 14 and an air curtain 24 are also used in order to define the covered area 9. Within the covered area 9 the equipment 4, 7 conveying and guiding the paper web 5 are in addition arranged to operate so that the lint should not be able to accumulate on any area within the sphere of influence of the paper web, at least in a harmful manner, in order to improve the runability of the paper machine.

Figure 2:
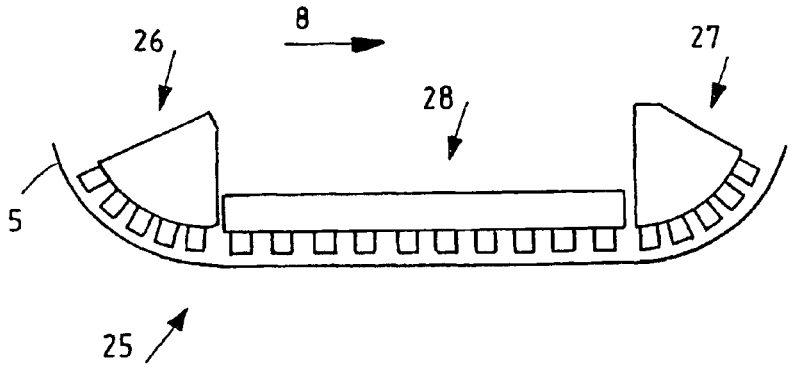
FIG. 2 shows schematically in a side view an air redirecting and air suspension conveying arrangement for the paper web according to the arrangement of FIG. 1.

FIG. 2 shows in more detail at the reference numeral 25 a web guiding means which includes air redirecting devices 26 and 27 for non-contacting redirecting of the paper web 5, and between these devices an air suspension conveying device 28 which also in a non-contacting manner conveys the paper web forward. The arrow 8 shows the machine direction. The construction of the paper machine's dry end determines whether both air redirecting devices 26 and 27 are required. Also the angle, at which the paper web 5 must by redirected in the air redirecting devices 26, 27, depends on the construction and dimensioning of the paper machine's dry end. Also the air suspension conveying device 28 can have a structure where the paper web slightly changes its direction (not shown). It should also be observed that, when required, the air redirecting devices 26, 27 and the air suspension conveying device 28 can also dry the paper web 5. The air supplied by these devices to the paper web 5, for the purpose of conveying or redirecting, can even be very hot, which provides an additional drying of the paper web. The additional drying by air suspension enables the doctoring of the web at a higher moisture, whereby less lint is created. According to the requirements the air supplied by the air redirecting device 26 can be hotter or colder than the air acting on the paper web 5 in the area of the air suspension conveying device 28, and the same applies of course also to the air redirecting device 27.

Figure 3:
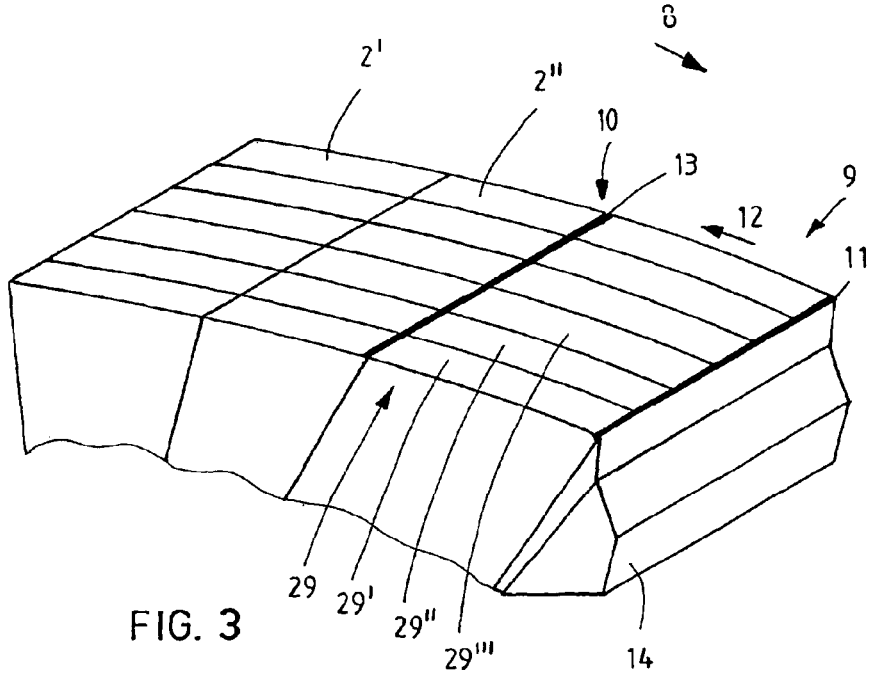
FIG. 3 shows schematically in a three-dimensional view the upper structure of the covered area of the arrangement according to FIG. 1.

FIG. 3 shows, in the machine direction 8 shown by an arrow, a covered area 9 after the halves 2', 2" of the hood 2, whereby the upper part of the covered area is formed by plates 29 (29', 29", 29'" and so on). Said plates are joined by seaming, and therefore the seams between the plates form slightly raised ridges in the paper machine's longitudinal direction. The slot nozzles of the blow boxes 11 and 13 blow air in the direction of the arrow 12. Said ridges direct the air blows so that they are kept in the direction of the arrow 12. An additional blow box (not shown) can be mounted, when required, close to the interface between the hood halves 2', 2" in order to make the blow even more effective, in the same way as said blow boxes 11 and 13.

Figure 4:
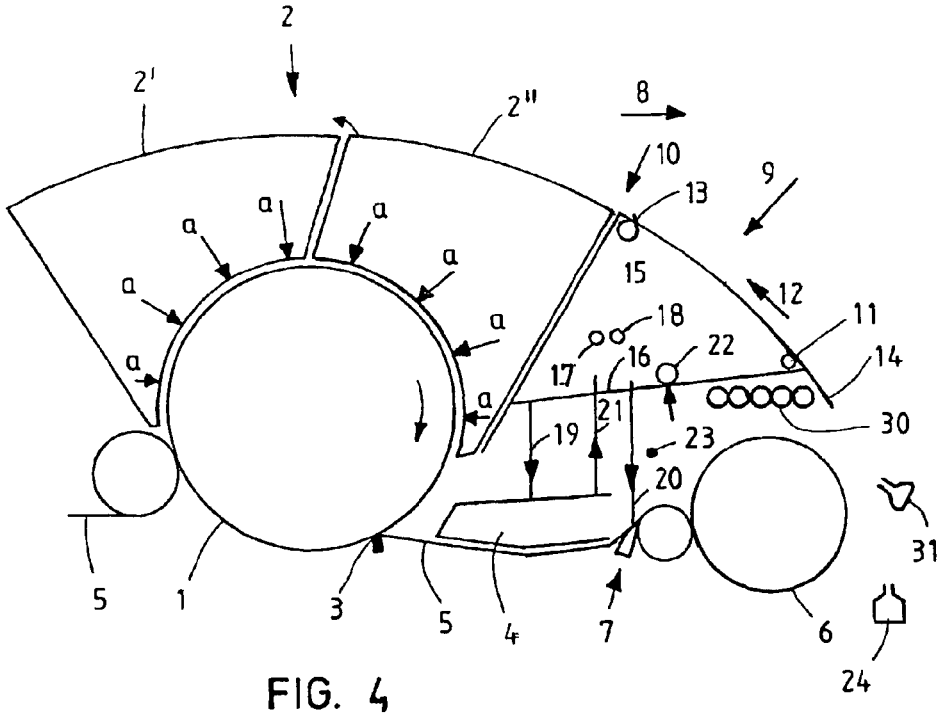
FIG. 4 shows schematically in a side view another arrangement like that of FIG. 1 at the dry end of a paper machine.

In the arrangement according to FIG. 4 the covered section 9 has a clearly curved upper part, as seen from one side of the paper machine, and also the upper part of the hood 2 is curved. The figure also shows the rolls 30 of the roller expecting a rolling action. The movable part 14 is located at the end of the covered area 9. The air curtains 24 and 31 close to the roller direct the flows into the space 23 and further out from there into the discharge flow box 22.

Figure 5:
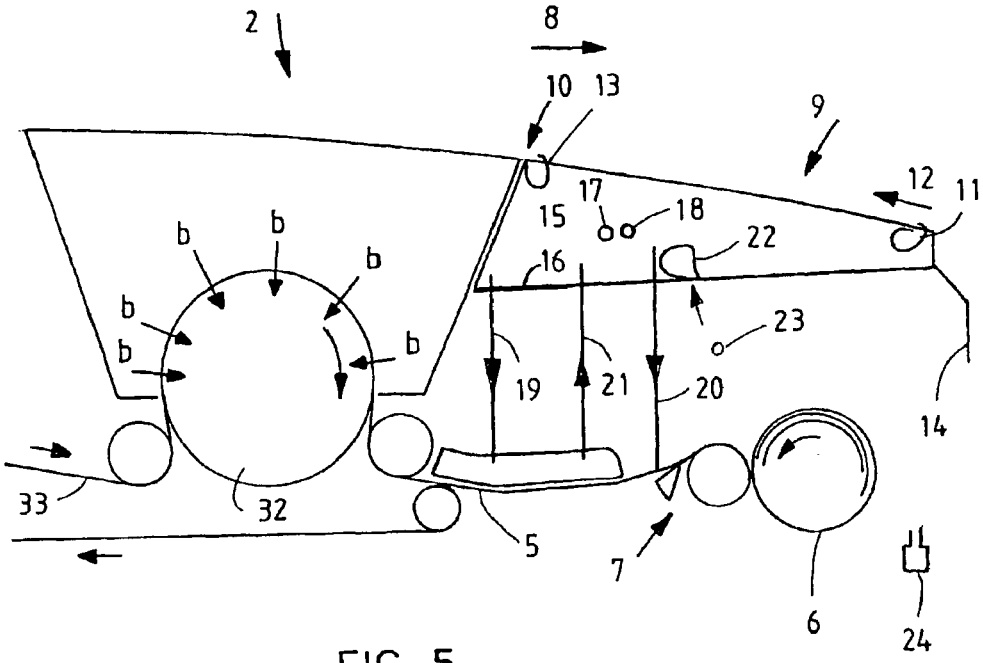
FIG. 5 shows schematically an arrangement like that of FIG. 1, but here a so called through air drying cylinder provided with a wire is used as the drying cylinder.

The arrangement according to FIG. 5 utilizes a perforated drying cylinder 32, where the paper web 5 is on a wire 33. Such an arrangement is called through air drying, as there are a plurality of holes in the surface of the drying cylinder 32, through which air is sucked through the wire 33 into the drying cylinder 32, in principle in the direction shown by the arrows b. The use of through air drying generally requires more effective additional drying arrangements between the drying cylinder 32 and the roller 6 than the use of a Yankee cylinder, but in FIG. 5 these devices known as such, for instance drying cylinders, are not shown. However, it is essential that the lint is removed effectively from the area between the drying cylinder and the roller, and that the covered area 9 extends also over these regions.

The arrangement according to the invention can be used not only in connection with new paper machines, but also in connection with old machines when their equipment at the dry end is replaced. A space 23 with negative pressure, a chamber 15 and web conveying means 4 according to the invention can be arranged below the covered area 9, whereby the object of the invention is fulfilled. If the hood 2 of the Yankee cylinder 1 is not replaced, then it is possible to arrange blow boxes (not shown) in the upper part of the hood which have the same object and operating principle as the blow box 11.

The invention is not limited to the enclosed embodiment, but several modifications of it are conceivable within the scope of the enclosed claims.

What is claimed is:

1. A papermaking machine dry end comprising:

a Yankee drying cylinder;

a hood covering the Yankee dryer cylinder, the hood connected to a source of drying air;

a paper web wrapping the Yankee dryer cylinder;

a doctor blade engaged with the Yankee drying cylinder, the paper web extending from the doctor blade on the Yankee drying cylinder to a roller which rolls the paper web, the direction from the doctor blade to the roller defining a machine direction;

an air suspension device arranged above the paper web between the doctor blade and the roller to convey the paper web in a non-contact manner to the paper roller; and a structure which joins the hood, said structure forming a covered area which extends substantially from the hood covering the Yankee drying cylinder to the roller.

2. The apparatus of claim 1 wherein the structure forming a covered area is a hood extending to the roller.

3. The apparatus of claim 1 wherein the structure forming a covered area is connected to the hood covering the Yankee dryer cylinder.

4. The apparatus of claim 1 wherein the air suspension device is arranged to redirect the paper web within the covered area.

5. The apparatus of claim 1 wherein the air suspension device comprises at least one redirecting device and at least one conveying device.

6. The apparatus of claim 5 wherein the air suspension device comprises two redirecting devices and the conveying device is connected between said two redirecting devices.

7. The apparatus of claim 1, further comprising a source of heated air connected to the air suspension device.

8. A papermaking machine dry end comprising:

a Yankee drying cylinder;

a hood covering the Yankee dryer cylinder, the hood connected to a source of drying air;

a paper web wrapping the Yankee dryer cylinder;

a doctor blade engaged with the Yankee drying cylinder, the paper web extending from the doctor blade on the Yankee drying cylinder to a roller which rolls the paper web, the direction from the doctor blade to the roller defining a machine direction;

an air suspension device arranged above the paper web between the doctor blade and the roller to convey the paper web in a non-contact manner to the paper roller;

a structure forming a covered area which extends substantially from the hood covering the Yankee drying cylinder and which extends at least to the roller; and wherein the structure forming a covered area comprises a chamber having a lower wall which separates the chamber from a space below the chamber and wherein the chamber is connected to a source of positive pressure.

9. A papermaking machine dry end comprising:

a Yankee drying cylinder;

a hood covering the Yankee dryer cylinder, the hood connected to a source of drying air;

a paper web wrapping the Yankee dryer cylinder;

a doctor blade engaged with the Yankee drying cylinder, the paper web extending from the doctor blade on the Yankee drying cylinder to a roller which rolls the paper web, the direction from the doctor blade to the roller defining a machine direction;

an air suspension device arranged above the paper web between the doctor blade and the roller to convey the paper web in a non-contact manner to the paper roller;

a structure forming a covered area which extends substantially from the hood covering the Yankee drying cylinder and which extends at least to the roller; and at least one blowing device positioned to blow air over an upper surface of the structure forming the covered area.

10. A papermaking machine dry end comprising:

a Yankee drying cylinder;

a hood covering the Yankee dryer cylinder, the hood connected to a source of drying air;

a paper web wrapping the Yankee dryer cylinder;

a doctor blade engaged with the Yankee drying cylinder, the paper web extending from the doctor blade on the Yankee drying cylinder to a roller which rolls the paper web, the direction from the doctor blade to the roller defining a machine direction;

an air suspension device arranged above the paper web between the doctor blade and the roller to convey the paper web in a non-contact manner to the paper roller;

a structure forming a covered area which extends substantially from the hood covering the Yankee drying cylinder and which extends at least to the roller; and an air curtain positioned downstream in the machine direction of the roller, the air curtain directing air toward the structure forming the covered area.

11. A papermaking machine dry end comprising:

a Yankee drying cylinder;

a hood covering the Yankee dryer cylinder, the hood connected to a source of drying air;

a paper web wrapping the Yankee dryer cylinder;

a doctor blade engaged with the Yankee drying cylinder, the paper web extending from the doctor blade on the Yankee drying cylinder to a roller which rolls the paper web, the direction from the doctor blade to the roller defining a machine direction;

an air suspension device arranged above the paper web between the doctor blade and the roller to convey the paper web in a non-contact manner to the paper roller;

a structure forming a covered area which extends substantially from the hood covering the Yankee drying cylinder and which extends at least to the roller; and a source of negative pressure arranged in communication with a space formed between the air suspension device and the structure forming a covered area.

12. A papermaking machine dryer section comprising:

a drying cylinder having a surface and a plurality of holes in the surface of the drying cylinder, and a source of reduced pressure so that air is sucked into the drying cylinder through the plurality of holes;

a hood covering the drying cylinder, the hood connected to a source of drying air;

a wire wrapping the drying cylinder;

a paper web on the wire wrapping the dryer cylinder, wherein the paper web extends from the drying cylinder to a roller which rolls the paper web, the direction from the drying cylinder to the roller defining a machine direction;

an air suspension device arranged above the paper web between the drying cylinder and the roller to convey the paper web in a non-contact manner, at least part of the way to the paper roller; and a structure which joins the hood, said structure forming a covered area which extends substantially from the hood covering the drying cylinder to the roller.

13. A papermaking machine dryer section comprising:

a drying cylinder having a surface and a plurality of holes in the surface of the drying cylinder, and a source of reduced pressure so that air is sucked into the drying cylinder through the plurality of holes;

a hood covering the drying cylinder, the hood connected to a source of drying air;

a wire wrapping the drying cylinder;

a paper web on the wire wrapping the dryer cylinder, wherein the paper web extends from the drying cylinder to a roller which rolls the paper web, the direction from the drying cylinder to the roller defining a machine direction;

an air suspension device arranged above the paper web between the drying cylinder and the roller to convey the paper web in a non-contact manner, at least part of the way to the paper roller;

a structure forming a covered area which extends substantially from the hood covering the drying cylinder to at least the roller; and wherein the structure forming a covered area comprises a chamber having a lower wall which separates the chamber from a space below the chamber and wherein the chamber is connected to a source of positive pressure.

14. A papermaking machine dryer section comprising:

a drying cylinder having a surface and a plurality of holes in the surface of the drying cylinder, and a source of reduced pressure so that air is sucked into the drying cylinder through the plurality of holes;

a hood covering the drying cylinder, the hood connected to a source of drying air;

a wire wrapping the drying cylinder;

a paper web on the wire wrapping the dryer cylinder, wherein the paper web extends from the drying cylinder to a roller which rolls the paper web, the direction from the drying cylinder to the roller defining a machine direction;

an air suspension device arranged above the paper web between the drying cylinder and the roller to convey the paper web in a non-contact manner, at least part of the way to the paper roller;

a structure forming a covered area which extends substantially from the hood covering the drying cylinder to at least the roller; and at least one blowing device positioned to blow air over an upper surface of the structure forming the covered area.

15. A papermaking machine dryer section comprising:

a drying cylinder having a surface and a plurality of holes in the surface of the drying cylinder, and a source of reduced pressure so that air is sucked into the drying cylinder through the plurality of holes;

a hood covering the drying cylinder, the hood connected to a source of drying air;

a wire wrapping the drying cylinder;

a paper web on the wire wrapping the drying cylinder, wherein the paper web extends from the drying cylinder to a roller which rolls the paper web, the direction from the drying cylinder to the roller defining a machine direction;

an air suspension device arranged above the paper web between the drying cylinder and the roller to convey the paper web in a non-contact manner, at least part of the way to the paper roller;

a structure forming a covered area which extends substantially from the hood covering the drying cylinder to at least the roller; and an air curtain positioned downstream in the machine direction of the roller, the air curtain directing air toward the structure forming the covered area.

16. A papermaking machine dryer section comprising:

a drying cylinder having a surface and a plurality of holes in the surface of the drying cylinder, and a source of reduced pressure so that air is sucked into the drying cylinder through the plurality of holes;

a hood covering the drying cylinder, the hood connected to a source of drying air;

a wire wrapping the drying cylinder;

a paper web on the wire wrapping the dryer cylinder, wherein the paper web extends from the drying cylinder to a roller which rolls the paper web, the direction from the drying cylinder to the roller defining a machine direction;

an air suspension device arranged above the paper web between the drying cylinder and the roller to convey the paper web in a non-contact manner, at least part of the way to the paper roller;

a structure forming a covered area which extends substantially from the hood covering the drying cylinder to at least the roller; and a source of negative pressure arranged in communication with a space formed between the air suspension device and the structure forming a covered area.

* * * * *